US005190127A

United States Patent [19]

Cummings

[11] Patent Number: 5,190,127

[45] Date of Patent: Mar. 2, 1993

[54] CARD COLLECTION CARRYING CASE WITH THREE-RING BINDER

[76] Inventor: Don E. Cummings, 767 W. Alru St., Rialto, Calif. 92376

[21] Appl. No.: 814,816

[22] Filed: Dec. 31, 1991

[51] Int. Cl.[5] ..... A45C 13/00; G09F 19/00; B42F 13/00

[52] U.S. Cl. ..... 190/102; 40/159; 40/536; 190/109; 190/900; 206/232; 206/579; 402/4; 402/70; 402/77; 402/502

[58] Field of Search ..... 206/232, 425, 472, 473, 206/493, 455, 579; 190/900, 901, 102, 109; 402/502, 73, 76, 77, 4, 70; 40/159, 536

[56] References Cited

U.S. PATENT DOCUMENTS

| | | | |
|---|---|---|---|
| 2,119,314 | 5/1938 | Burdge et al. | 190/109 |
| 2,252,783 | 8/1941 | Potts et al. | 402/70 |
| 2,568,131 | 9/1951 | Segal | 402/70 |
| 3,133,631 | 5/1964 | Bolden | 206/232 X |
| 3,891,070 | 6/1975 | Montanari | 190/901 X |
| 4,163,559 | 8/1979 | Stenstrom . | |
| 4,255,872 | 3/1981 | Williams, Sr. | 206/232 X |
| 4,420,270 | 12/1983 | Rossello | 402/76 |
| 4,515,493 | 5/1985 | Radovich | 402/72 X |
| 4,588,321 | 5/1986 | Egly | 402/502 X |
| 4,794,713 | 1/1989 | Yang | 402/502 X |
| 5,050,740 | 9/1991 | Lucero . | |

FOREIGN PATENT DOCUMENTS

| | | | |
|---|---|---|---|
| 2172548 | 9/1986 | United Kingdom | 402/77 |

*Primary Examiner*—Bryon P. Gehman
*Attorney, Agent, or Firm*—Richard C. Litman

[57] ABSTRACT

A storage device and organizer is provided for card collections. The interior of the storage device is divided into a right, central and left zone by dividing slats permanently affixed to the case. The right and left zones are dimensioned in such a fashion to receive collectible cards in either a case or in a loose condition. The central region has a three-ring binding device included for the storage of cards placed in a transparent storage page. One may flip the pages or display a favorite page. The case has a handle for carrying and a latch for securing. A lock may be provided for security.

2 Claims, 1 Drawing Sheet

CARD COLLECTION CARRYING CASE WITH THREE-RING BINDER

FIELD OF THE INVENTION

The present invention relates to a carrying case and organizer for card collections. More specifically the present invention relates to a carrying and displaying device which can accommodate loose cars, card packs as well as display cards through the use of a three-ring binder and transparent plastic sheets.

DESCRIPTION OF THE PRIOR ART

Carrying cases for storage or organization are known in art. U.S. Pat. No. 4,163,559 issued to Sadie Stenstrom on Aug. 7, 1979 discloses a compartmented card box. The case is designed to store cards and other game pieces. No three-ring storage device or carrying handles are disclosed.

U.S. Pat. No. 5,050,740 issued to Eli Lucero discloses a compartmentalized case with three compartments. The case is designed for storage and transport of game playing pieces. The compartments are similarly dimensioned and no three-ring storage device is disclosed.

None of the above referenced devices, considered either singly or in combination, is seen to suggest the instant invention as claimed.

SUMMARY OF THE INVENTION

The instant invention is drawn to a case for the organization, storage, transport and display of collector cards and other valuable collector items, such as photographs or autographs. The instant invention is envisioned to store individual cards, boxed team collections, and other memorabilia in such a manner which can easily be transported and displayed at conventions or to just trade with other collectors at a neutral locale. This case provides a mechanism to easily organize trading cards as well as secure valuable trading cards and memorabilia against unauthorized access.

Accordingly, one object of the present invention is to provide a case to store collector cards and memorabilia.

Another object of the present invention is to provide a case to easily and safely transport collector cards and memorabilia.

Another object of the present invention is to provide a case to organize the collection cards in a meaningful fashion.

Another object of the present invention is to provide a case to display a collection of cards for trading or sale.

These and other objects of the present invention will become readily apparent upon further review of the following specification and drawings.

DETAILED DESCRIPTION OF THE PREFERRED EMBODIMENT

Figure 1:
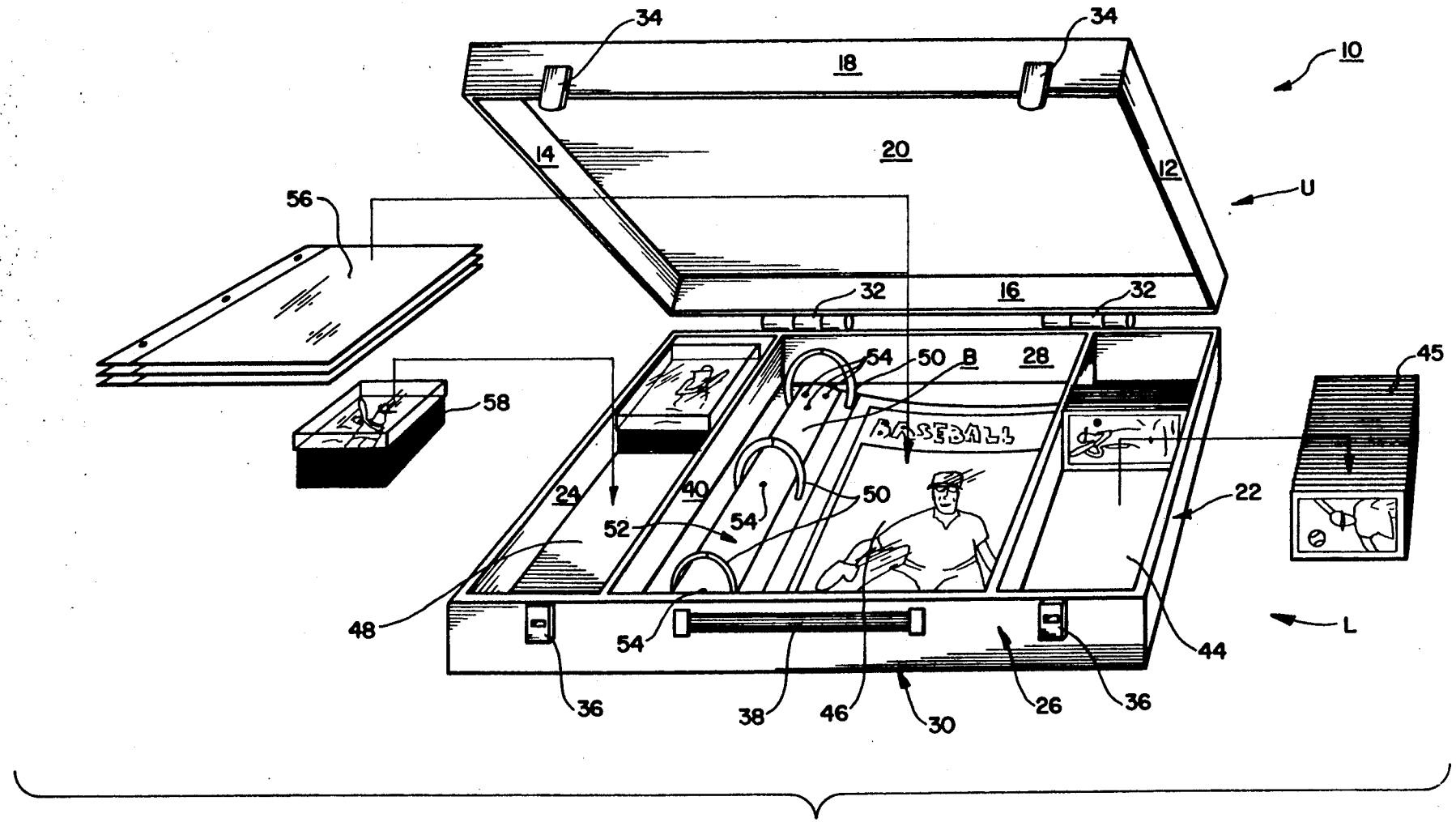
FIG. 1 is a perspective view of the instant invention showing the carrying case, collector card storage areas, and collector card display areas.

The present invention is a device which provides storage, transport, organization and display capacity for collector cards such as baseball cards. The case 10 includes a rectangular cover U having a flat top and four upright side walls and a a rectangular receptacle L having a flat bottom and four upright side walls. Cover U has a right wall 12, a left wall 14, a rear wall 16, a front wall 18 and a flat top 20 which are interconnected to form a rectangular box. The receptacle L has a right wall 22, a left wall 24, a front wall 26, a rear wall 28, and a flat bottom 30 or floor, which are also interconnected to form a rectangular box. The cover U and the receptacle L are connected together by a pair of hinges 32. The hinges 32 are located on the cover rear wall 16 and the receptacle rear wall 28. A pair of latches are provided which secures the cover U to the receptacle L. The male latches 34 are located on the cover front wall 18 and they mate with the female latches 36 which are located on the receptacle front wall 26. A handle 38 for carrying the case 10 when the case 10 is secured is located in the center of the receptacle front wall 26.

The receptacle L is divided into three sections by a left dividing wall 40 and a right dividing wall 42. The dividing walls 40, 42 are parallel to the right wall 22 and left wall 24 and are perpendicular to the front wall 26 and rear wall 28. The first cavity 44 is formed by the right wall 22 and the right dividing wall 42 and has a first dimension. The second cavity 46 is formed by the right dividing wall 42 and the left dividing wall 40 and has a second dimension. The third cavity 48 is formed by the left dividing wall 40 and the left wall 24 and has a third dimension. The second dimension is larger than the first dimension which is larger than the third dimension due to the specific organization capacity of the instant invention.

The first cavity 44 is dimensioned in such a way to received individual collector cards 45. These cards 45 are organized in such a way to be able to easily find any given card for trading purposes.

The second cavity 46 includes a three-ring binder system B located proximal the left dividing wall 40. The three rings 50 are integral with a ring mount 52 which is disposed proximal to the left dividing wall 40 and attached to the bottom wall 30 by rivets 54. The three rings 50 are designed to receive protective transparent plastic sheets 56. These sheets 56 can be divided to receive valuable individual cards or undivided to receive photographs or magazines. The plastic sheets 56 keep these valuable collector items in pristine or mint condition. It is envisioned that a locking system may be employed to secure the upper portion U to the lower portion L to secure valuable collectables.

The third cavity is dimensioned in such a way to receive boxed collector sets 58. These collector sets 58 are for example comprised of cards of all the players on the Los Angeles Dodgers during the 1991 season. These collector sets 58 are valuable and prized by collectors.

It is to be understood that the present invention is not limited to the sole embodiment described above, but encompasses any and all embodiments within the scope of the following claims.

I claim:

1. A case for organization, storage, transport and display of collector items, said case comprising:

a rectangular cover having a flat top and four upright side walls;

a rectangular receptacle having a flat bottom and four upright side walls, said receptacle being divided into a first cavity dimensioned to receive a plurality of separate collector cards, a second cavity containing a three-ring binder and a third cavity dimensioned to receive a plurality of boxed collector cards, said three-ring binder being mounted to said flat bottom of the receptacle end removably holding a plurality of protective transparent plastic sheets within the second cavity;

carrying means for transporting said case;

hinge means for connecting the cover to the receptacle; and latching means for securing said cover to said receptacle.

2. The case according to claim 1, wherein the second cavity is substantially larger than the first cavity and is centrally disposed within said rectangular receptacle.

* * * * *